US006131434A

United States Patent [19]

Schneider, Jr.

[11] Patent Number: 6,131,434

[45] Date of Patent: Oct. 17, 2000

[54] COMBINATION PNEUMATIC HAMMER, SPRING AND GUIDE FOR CHISELS IN USE FOR SEALING PITTSBURGH LOCK SEAMS

[76] Inventor: Edward J. Schneider, Jr., 306 Myrtle, West Plains, Mo. 65775

[21] Appl. No.: 09/342,271

[22] Filed: Jun. 29, 1999

Related U.S. Application Data

[60] Provisional application No. 60/091,251, Jun. 30, 1998.

[51] Int. Cl.[7] ..... B21D 31/06

[52] U.S. Cl. ..... 72/479; 72/379.2; 72/479; 72/453.15; 29/243.5

[58] Field of Search ..... 72/479, 480, 379.2, 72/453.15; 29/243.5, 243.58

[56] References Cited

U.S. PATENT DOCUMENTS

| | | | |
|---|---|---|---|
| 2,353,559 | 7/1944 | Hajek, Jr. | 72/479 |
| 2,637,292 | 5/1953 | George, Jr. | 72/479 |
| 3,188,729 | 6/1965 | Pogue, Jr. et al. | 29/243.58 |
| 3,426,573 | 2/1969 | Wilson, Jr. | 72/434 |
| 4,649,733 | 3/1987 | Gilmore | 72/479 |
| 5,095,735 | 3/1992 | Schneider, Jr. | 72/479 |

OTHER PUBLICATIONS

Advertisement in Trade Journal entitled "SNIPS," dated Sep., 1989.

*Primary Examiner*—David Jones

*Attorney, Agent, or Firm*—Jonathan A. Bay

[57] ABSTRACT

A tool for folding sheet metal edges includes the following. A pneumatic hammer has a stepped barrel with an externally cylindrical proximal portion and a reduced-down distal portion externally formed with inverse spring thread. A plunger has a shank with a work-striking head, a spaced away butt end that loads into the hammer barrel, and an intermediate axial-stop enlargement disposed therebetween. A spring for retention of the plunger and has a main body formed on a major diameter, a shank-latching portion formed on a minor diameter, and a transition section therebetween. The main body has a series of closed regular coils which partly thread onto the inverse spring thread of hammer barrel and in other part which, with inclusion of the transition section, generally project so that the shank-latching portion latches across the shank of the plunger just forward of the axial stop. That way, axial extensions of the spring normally retract the plunger back into the hammer barrel. A rigid guide has a base end with a clamping mechanism for clamping onto the hammer barrel's proximal portion. At the other end, it has a guide lip which, while the guide is attached to the hammer, projects past and below the striking head of the plunger. It also has an intermediary channel portion which internally closely surrounds portions of the spring for buttressing the transition section of the spring, and those coils of the main body proximate thereto, from off-axis excursions.

20 Claims, 6 Drawing Sheets

COMBINATION PNEUMATIC HAMMER, SPRING AND GUIDE FOR CHISELS IN USE FOR SEALING PITTSBURGH LOCK SEAMS

CROSS-REFERENCE TO PROVISIONAL APPLICATION(S)

This application claims the benefit of U.S. Provisional Application No. 60/091,251, filed Jun. 30, 1998.

BACKGROUND OF THE INVENTION

1. Field of the Invention

The invention generally relates to sheet metal folding or seaming by handheld power tools. More particularly, the invention relates to, in combination, a pneumatic hammer, spring retainer and guide. The combination is used with a mushroom-headed chisel to close or seal the seam in a corner interlock common to sheet metal, popularly known as the "Pittsburgh lock."

2. Prior Art

Whereas FIG. 1 shows a tool combination 10 in accordance with the invention, at present FIG. 1 serves the purpose of illustrating one representative way of sealing such a comer seam of sheet metal duct work 32 that is known as a Pittsburgh lock. In FIG. 1, there is a pneumatic hammer 12 and a mushroom-headed chisel 14. (In some instances, the chisel 14 is referred to by a generally interchangeable term, ie., "plunger"). In addition, there is a guide 18 and spring retainer 20 which will all be described much more particularly below.

FIG. 2 shows an enlarged scale fragment of a rectangular sheet metal duct work 32 (eg., "enlarged" relative to the fragment of sheet metal duct work 32 shown by FIG. 1). In particular, FIG. 2 shows a corner where the "Pittsburgh lock" seam is formed at the right-angle intersection between two sidewalls 34 and 48. One sidewall 34 is formed with an S-fold 35 between a main web 36 thereof and a flap extension 38 that runs out in a free edge 42. The flap extension 38 is shown in solid lines folded over as in a completed position. Phantom lines (ie., dot-dash) show the flap extension 38 in its original position in phantom lines, before the folding over operation with the tool combination 10 shown by FIG. 1.

The S-fold 35 includes a flattened inner loop 44 and an open-channel outer loop 46 defining an open channel having a width about the thickness of the sheet metal. The flap extension 38 emerges from the tag end of the outer loop 46. The other sidewall 48 has its free edge formed with a bent-in flange 52. This flange 52 is arranged to nest in the outer loops 46's open channel. The closing or sealing of this corner is achieved by folding over the flap extension 38 of the S-folded sidewall 36 flush against the main web of the flanged sidewall 48, as indicated by the direction arrow given reference numeral 50. Hence this is the completed corner or seam in the sheet metal duct work 32 that is known as the "Pittsburgh lock."

As FIG. 1 represents, it is popular for workers in the field to close or seal this seam by handheld power-tool operations with, say, the tool combination 10 shown by the drawings, or else close analogs such as usually including at least as much as the air hammer 12, the mushroom-headed chisel 14, and some sort of a guide (eg., 18/18') or another.

Retainers (eg., inter alia, 70 and 84) are a desirable option to include for many reasons. A retainer keeps the chisel or plunger 14 from free-sliding out of the hammer barrel 53. That way, the chisel won't slide out each time the hammer barrel 53 tips down. Also, during hammering operations, typically the chisel rattles back and forth between an impact stroke from the hammer 12 and a bounce-back from striking the target.

Hence it is typically the target which returns or "reloads" the chisel to retraction within the hammer barrel 53. If the operator mistakenly misses the target, then a retainer is desirable to catch the chisel 14 and preventing it from flying away like some launched missile.

Viewing FIGS. 1, 3*a* and 3*b* in sequence show a typical operation of sealing the Pittsburgh lock seam. It presently is widely popular to use air hammers 12. The flap extension 38 of the S-fold is typically bent over in two or three "passes" of the air hammer 12. A first "pass" with the air hammer 12 oriented at about 45° to the seam (and as shown by FIG. 1) typically bends the flap 38 over to about a 45° angle for itself (eg., as shown for FIG. 3*a*). The term "pass" as used here indicates starting the operation at one left or right point or origin on the seam, and then progressing laterally to the respectively opposite right or left terminus of the seam (this is not shown as the lateral direction is directly into the depth of the views of FIGS. 1–3*b*). Second or third passes are executed as needed and as represented by FIGS. 3*a* and/or 3*b*, to complete the folding over of the flap 38 into its completed position.

Alignment of the air hammer 12 is assisted during the folding operation by the guide 18. There are a variety of commercially-available guide arrangements that attach to the barrel 53 of an air hammer. Examples of these are disclosed by U.S. Pat. No. 3,188,729—Pogue, Jr., and Wilson; U.S. Pat. No. 3,426,573—Wilson; commonly-owned, commonly-invented U.S. Pat. No. 5,095,735—Schneider, Jr.; and, the DORAN® Super Air Hammer™, as disclosed, inter alia, by an advertisement in the trade journal entitled "SNIPS," found in the September issue of 1989, page 81.

FIGS. 1, 3*a*, and 3*b*, as well as 4, 5, 8 and 9 show a guide attachment 18 in accordance with the invention for executing Pittsburgh lock operations. In some basic aspects this guide 18 is demonstrative of the prior art. In particular, this guide 18 comprises a wedge shape imposed on a tube. The guide extends between a tip end 54 of the wedge and a right-angle base end 56. The wedge angle is about 60° oblique to the axis of the tube. In use, the tip end 54 of the guide 18 props against the main web portion 36 of the S-folded sidewall 34, as shown by FIG. 1, spaced from the flap extension 38 about as shown, to maintain the angle-of-attack of the anvil-face 58 of the mushroom-headed chisel 14 at about 45° to the free edge of the flap extension 38. The tip end 54 of the wedge acts as a fulcrum and allows the user to pivot the air hammer 12 reversibly clockwise and counterclockwise relative to the vantage point of the views FIGS. 1, 3*a* and 3*b*. The user proceeds laterally along the S-folded sidewall 34 sliding the tip end 54 along in the process.

The guide 18 has its base end 56 formed with a clamping arrangement 60 for anchoring the guide 18 on a given "cylindrical base fixture." More will be said herein below about "cylindrical base fixtures." To turn briefly to FIG. 5, this clamping arrangement 60 may be configured as follows. The guide 18's base end 56 is bifurcated by a slot 62 traversing a transection (ie., an axial band on a cylindrical wall, it being perpendicular a "cross-section" cut across the cylinder or tube) of the tubewall. The slot 62 bifurcates the guide vis-a-vis traversing through the narrowest span between the base end 56 and the wedge. The slot 62 is flanked by a pair of spaced eye-loops 64 and 66 or the like.

A machine screw 68 inserts through and spans between the two eye-loops 64 and 66. As shown by FIG. 5, the far eye-loop 66 is given internal screw thread that matches the thread of the machine screw 68. The near eye-loop 64 is smooth and allows free passage of the machine screw 68. Hence tightening the machine screw 68 causes the tubewall to contract and more tightly encircle the respective "cylindrical base fixture" over which the guide 18 may be telescoped, to thereby fix the guide 18 in place.

FIG. 4 shows a prior art tool combination of air hammer 12, chisel 14, guide 18', and mechanical locking retainer 70. This mechanical locking retainer 70 is a screw-on assembly that attaches/detaches to the barrel 53 of air hammer 12 by means of inverse spring thread. This mechanical locking retainer 70 to date has been used extensively by workers in the field for chucking the chisel (eg., 14) they intend to use for Pittsburgh lock work.

As FIG. 4 shows, the "cylindrical base fixture" for the guide 18' to clamp to here is, the prior art mechanical locking retainer 70.

By way of background, the chisel 14 shown in the drawings is known in the trade as a "0.401 shank" type chisel. That is, the chisel 14 has a shank 71 including a reduced end 72 which measures 0.401-inches (eg., ~1 cm) in diameter. The reduced end 72 can measure about 1¼0 inches (3.2 cm) long or so, to where it merges into a radial expansion 73 forming an axial stop. The side of the axial stop 73 that faces the barrel 53 is chamfered or skirted or the like:—the other side is more plainly flat. As was indirectly referenced above, the air hammer barrel 53 is formed with inverse spring thread 75, and the mechanical locking retainer 70 includes a matching formation of internal round thread.

This mechanical locking retainer 70 allows "snap-in" chucking of the chisel 14. The mechanical locking retainer 70 has a main sleeve 76 which is sufficiently hollow to pass the axial-stop expansion 73 of the chisel 14. The mechanical locking retainer 70 also has a telescoped collar 77 that actuates a set of four locking balls 79 (only three in view). The locking balls 79 when locked (as shown) retain the chisel 14 by blocking the passage of the axial stop 73.

The main sleeve 76 of the mechanical locking retainer 70 includes a flared-out threaded portion. The other portion of the sleeve 76 is formed with four radially-countersunk openings or "ball-sockets" 80 (only one in view), all in a common axial plane, and angularly distributed 90° or so apart. The balls 79 are radially displaceable between radially-in or "locking" positions as shown, and radially-out or "unlocking" positions in which the balls 79 retreat into an inside groove 81 in the telescoping collar 77. The countersink feature of the socket openings 80 keep the balls 79 from falling into the hollow core of the sleeve 76.

The telescoping collar 77 telescopes over the sleeve 76 and is axially displaceable between a spring-biased extreme of extension (as shown and as limited by a split ring 83) and an extreme of retraction (not shown) to which a user must force the collar 77 against the opposition of the open-coil compression spring 84. The inside groove 81 of the collar 77 has a trailing cusp 85 which forms a cam surface that forces the balls 79 in the radially-in or "locking" position as shown. Axially retracting the collar 77 toward the air-hammer barrel 53 moves the inside groove 81 in registry with the locking balls 79 so that the locking balls 79 can retract therein. By doing that, a user has unlocked the mechanical locking retainer 70 and can change out the chisel 14 for another chisel, or else for a different kind of 0.401-inch shank tool-bit.

There are shortcomings associated with this arrangement that is illustrated by FIG. 4. The mechanical locking retainer 70 is a persistent source of problems. There is no problem that the locking balls 79 are sufficient at preventing the chisel 14 from falling out during non-use. Likewise, during proper use, there are again no problems as the chisel 14 vibrates rapidly between a thrust stroke given by the hammer 12 and a recoil stroke after the anvil 58 has bounced off the "target" object (eg., in Pittsburgh lock operations, the target object is the flap extension 38 as shown by FIGS. 1–3*b*). It is common, however, for the air hammer 12 to be errantly triggered before anvil 58 can be placed against the target object. When that happens, the thrust stroke is absorbed entirely by the locking balls 79 by way of the axial stop 73. Whereas this is a form of abuse of the locking balls 79, it is a mishap which nevertheless happens on occasions to even the most experienced workers in the field.

Despite that this is a foreseeable form of mis-use of the mechanical locking retainer 70, the locking balls 79 simply cannot withstand the thrust strokes of the chisel 14. Too much abuse and the chisel's axial stop 73 flattens the balls 79, or jams itself between the balls 79, either ruining the mechanical locking retainer 70 or sometimes so permanently pressing the axial stop 73 into the retainer's balls 79 that the mechanical locking retainer 70 and chisel 14 are more or less permanently welded together. The mechanical locking retainer 70 and/or chisel 14 can of course be replaced, but it is a needless expense that no one willingly wants to incur.

Other devices and mechanisms for chucking the chisel 14 are known. But surveys among workers in the field will show that, this mechanical locking retainer 70 of FIG. 4 is very popular because, on a comparative basis, it provides many advantages over the other prior art chucking devices. Simply put, there are worse problems with the other devices some of which will be discussed more particularly below in connection with FIGS. 6 and 7.

To be brief, the other devices aren't as reliable at leashing in the chisel 14. The mechanical locking retainer 70 reliably prevents the unleashing of the chisel 14 and its launching like a missile. However, the mechanical locking retainer 70 often does this to its own ruin, which is a costly loss.

Hence the time is ripe for an improvement which overcomes the problems of the mechanical locking retainer 70 shown by FIG. 4, without detracting from the advantages of positive tool-retention it provides.

SUMMARY OF THE INVENTION

It is an object of the invention to provide a tool for folding sheet metal edges which re-incorporates a retainer spring like the conventional beehive springs except fashioned for more reliably holding onto the chisel.

It is an alternate object of the invention that the above tool comprise a pneumatic hammer, a chisel, the aforementioned spring and a guide.

It is an additional object of the invention that the foregoing guide include a buttressing section which extends closely surrounding portions of the retaining spring. That way, the buttressing section can prevent off-axis excursions of the spring, which is the major cause of why the latching grip of the spring on the chisel shank unlatches and loses the chisel.

These and other aspects and objects are provided according to the invention in a tool for folding sheet metal edges that includes a pneumatic hammer, a chisel or "plunger," a retaining spring therefor and a rigid guide. The pneumatic hammer has a stepped barrel which includes an externally cylindrical proximal portion and a reduced-down distal portion that is externally formed with inverse spring thread. The plunger has a shank that extends between a work-striking head and a butt end that loads into the hammer barrel. The plunger also has an intermediate axial-stop enlargement disposed therebetween. The spring has a main body formed on a major diameter, a shank-latching portion formed on a minor diameter, and a transition section therebetween. The spring's main body has a series of closed regular coils which partly thread onto the inverse spring thread of hammer barrel and in other part which, with inclusion of the transition section, generally project so that the shank-latching portion latches across the shank of the retracted plunger just forward of the axial stop. That way, axial extensions of the spring normally retract the plunger back into the hammer barrel. The guide has a base end formed with an internally cylindrical clamping mechanism for clamping onto the hammer barrel's proximal portion. At the other end, it has a guide lip which, while the guide is attached to the hammer, projects past and below the striking head of the plunger. The guide lip is situated to prop and/or slide against a wall of sheet metal and also act as a fulcrum and hence allow a user to vary the angle-of-attack of the work-striking head relative to the work-piece/sheet metal edge.

An inventive aspect of the guide is that it has an intermediary channel portion which internally closely surrounds portions of the spring for buttressing the transition section of the spring, and those coils of the main body proximate thereto, from off-axis excursions. This prevents the latching portion of the retaining spring from unlatching OFF the shank of the plunger.

Optionally the rigid guide can be substantially formed from a tube being generally cross-section cut at the base end, and at the other end, being formed in a wedge shape in which the guide lip is defined by the tip end of the wedge. The wedge shape may be cut along a straight slice.

The intermediary channel portion of the guide may be defined by an internally cylindrical transect portion of the tube as given a diameter being sized to measure about equal to the major diameter of the plunger-retaining spring except including a measure for closely spaced clearance.

The clamping means can comprise forming the guide's base end with a slot that bifurcates the base end generally at the narrowest span between the base end and the wedge, and then providing a pair of spaced eye-loops flanking the slot and a threaded fastener spanning between the two eye-loops such that tightening the fastener causes the tubewall to contract and more tightly clamp on the round proximal portion of the hammer barrel.

Preferably the transition section of the spring comprises an involuted cone which may be formed by a half a coil that reverses the direction of coiling relative to the spring's main body of coils, wherein this reversing half-coil is generally contained in the imaginary surface of a cone. The shank-latching portion of the spring may comparably comprise a partial coil having a diameter about equal to the diameter of the plunger shank.

Optionally the plunger-retaining spring may further comprise opposite hook ends, one which forms the terminus for the main body and extends externally such that it projects radially outward along an imaginary spoke from the center axis of the spring, and the other which forms the terminus for the shank-latching portion and is formed offset such that it projects radially outward along an imaginary tangent of the shank-latching partial-coil. If the guide is formed from a tubular form, then it might be provided with a clearance gap that extends in transection and which bifurcates the guide including the base end, wherein the clearance gap is arranged to provide sufficient clearance for the spring's hook ends as at least to allow free axial displacement between the guide and the shank-latching portion's hook end.

Also, this clearance gap, as formed in the guide's base end and while the guide is clamped on the hammer barrel, permits the through extension of the main body's hook end concurrently as the guide's base end prevents by obstruction the retainer spring from unscrewing OFF the inverse thread portion of the hammer barrel.

Additional aspects and objects of the invention will be apparent in connection with the discussion further below of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 5:
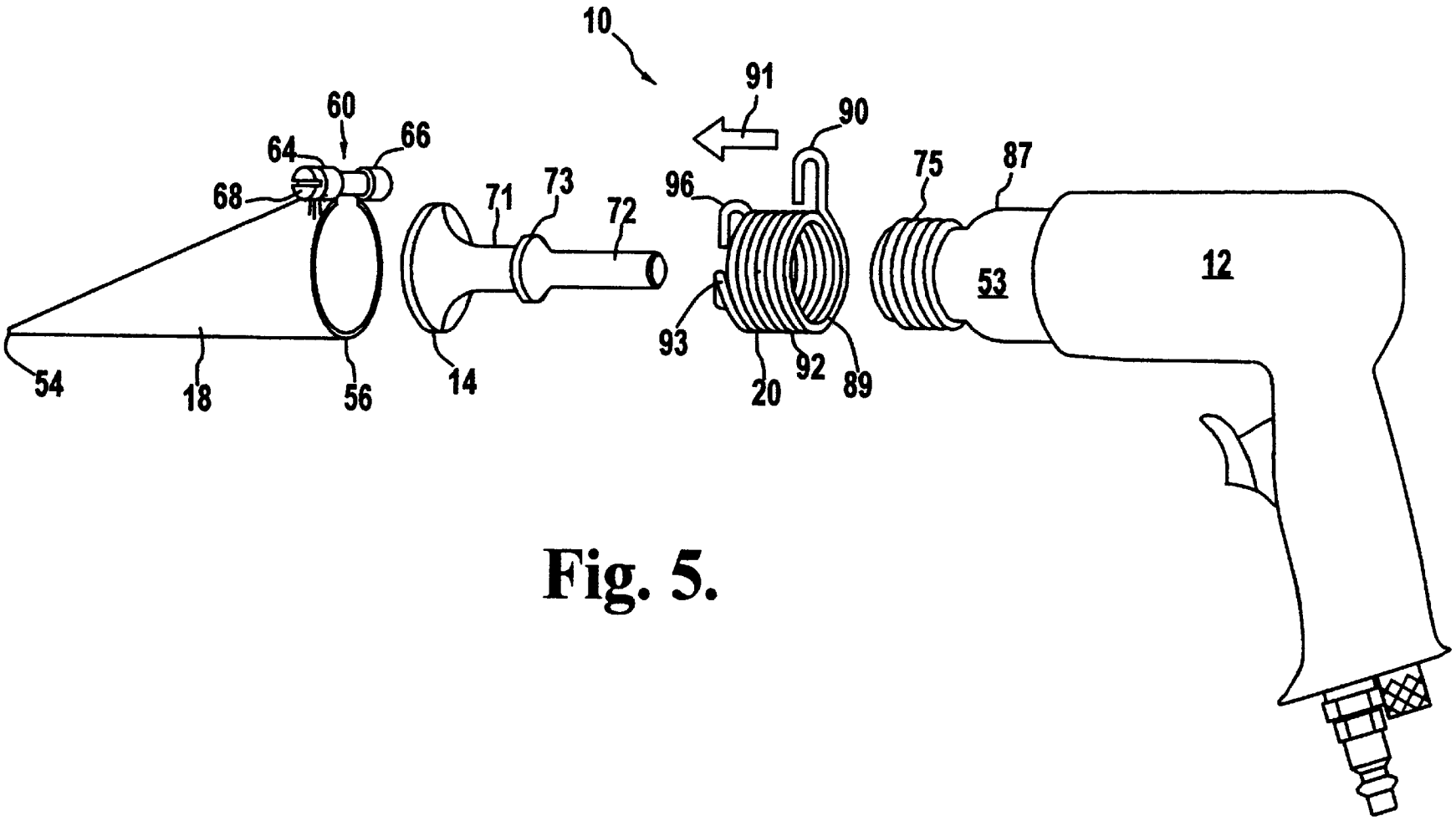
FIG. 5 is an exploded perspective view of the tool combination shown by FIG. 1.

FIG. 5 shows a tool combination 10 in accordance with the invention, for sealing "Pittsburgh lock" seams in sheet metal duct works. The tool combination 10 comprises a spring retainer 20 and guide 18 for cooperatively attaching to a pneumatic hammer 12. The pneumatic hammer 12 is available from many commercial sources, and is characterized by a stepped barrel having the inverse spring thread 75 formed on its reduced-down portion. The barrel 53 has an internal bore (not in view) sized for handling the 0.401-inch diameter reduced end 72 of the mushroom-headed chisel 14. Adjacent the inverse spring thread on the barrel 53 is a generally smooth, externally cylindrical portion 87 of a somewhat enlarged diameter.

Figure 7:
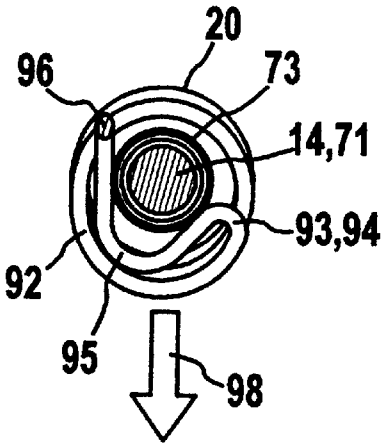
FIG. 7 is a section view taken along line VII—VII in FIG. 6.
Figure 8:
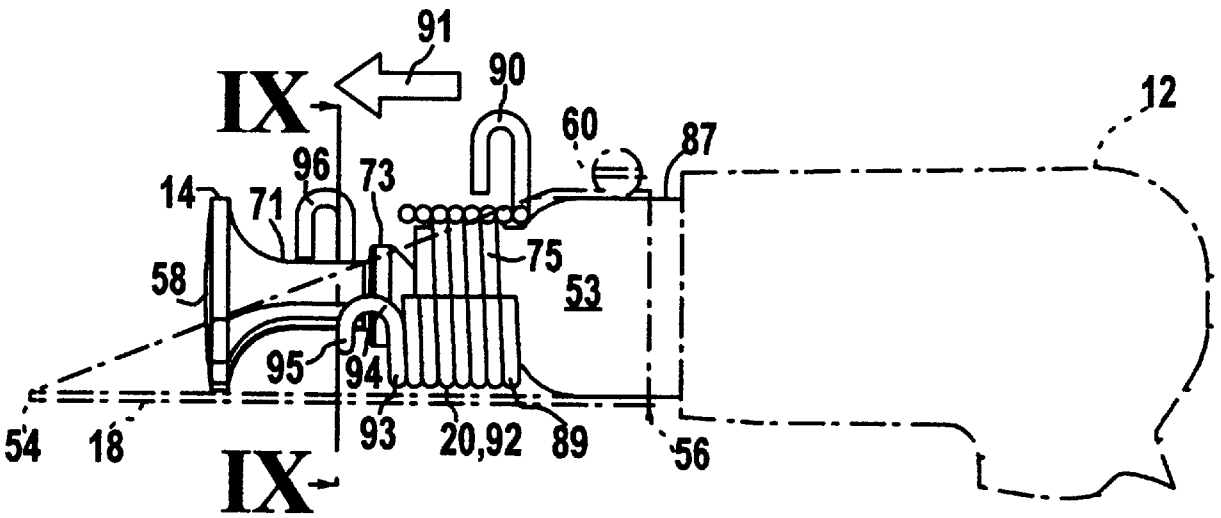
FIG. 8 is a side view comparable to FIG. 6 except with the guide re-installed; and, FIG. 9 is a section view taken along line IX—IX in FIG. 8.

FIG. 8 shows that the base end 56 of the guide 18 mounts on the smooth cylinder portion 87 of the barrel 53. Hence this smooth portion 87 here serves as the "cylindrical base fixture" to mount the guide 18. The guide 18' shown by FIG. 4 differs from the guide 18 of FIGS. 1, 3*a*, 3*b*, and 5–9 in that the FIG. 4 guide 18' has a slightly larger overall diameter. The guide 18 for use in the tool combination 10 in accordance with the invention is scaled down slightly to mount on the smooth portion 87 of the air hammer 12 barrel 53 as shown by FIG. 8 (among other views). The chisel 14 is retained in a use-engagement with the barrel 53 by means of the spring retainer 20.

More particularly, this spring retainer 20 has a base end 89 formed with a hook 90 extending externally such that it projects radially outward along an imaginary spoke from the center axis of the spring retainer 20 (eg., refer to FIG. 5). The spring retainer 20 extends forward from the base end 89 along the direction indicated by arrow 91, toward the forward end of the spring retainer 20 (eg., refer to FIGS. 6 or 8). From this origin in the base-end loop 89, the main body 92 of the spring retainer 20 is formed as a series of closed, regular coils 92. These closed coils 92 abruptly change into a involuted coned end 93. In fact this kind of retainer spring 20 is commonly termed "beehive" spring because of the tapering coils that form the coned or beehive portion 93. This beehive portion 93 is also "involuted:"—ie., formed as follows.

Figure 9:
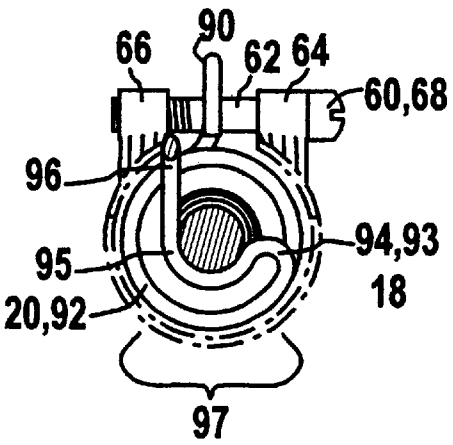

The taper of the beehive portion 93 can partially be reckoned by comparing FIG. 5 with FIGS. 8 and 9. The beehive portion 93 includes half a coil 94 reversing the direction of coiling 92 (eg., involuted) in the spring retainer 20 (eg., see FIGS. 8 and 9). This half coil 94 which reverses the direction of coiling is generally contained in the imaginary surface of a cone (or the taper or the like). This reversing-half coil 94 then changes into a half coil 95 of a reduced-diameter (see FIG. 9) but square with or perpendicular to the axis of the spring retainer 20 (see FIG. 8).

Hence the reversing-half coil 94 functions as a transition between the major-diameter main coils 92 and the minor-diameter chisel-shank clip portion 95. Emerging from the chisel-shank clip or latching portion 95 is a forward tag end 96 of the spring 20. The forward tag end 96 finishes off as an offset hook 96 that projects radially outward along an imaginary tangent of the reduced-diameter half-coil 95 (see FIG. 9), and extending in the forward direction 91 (see FIG. 8).

The offset hook 96 is the trailing end of the spring retainer 20 when a user screws the spring retainer 20 onto the inverse thread 75 of the barrel 53. A user typically drives the trailing offset-hook 96 by hand to get the spring retainer 20 to wind onto the inverse thread 75. Driving the spring retainer 20 trailing offset-hook 96 has the effect of slightly enlarging the diameter of the coils 92 ahead of the trailing offset-hook 96, and hence reduce the friction of the base-end coils 92/89 on the inverse thread 75.

There are at least compound ways of installing the guide 18 and spring retainer 20 onto the barrel 53. One preferred way comprises mounting the spring retainer 20 first on the barrel 53 first, and then telescoping the guide 18 over the spring 20 thereafter. To do this, it requires temporarily removing the machine screw 68 while sliding the eye-loops 64/66 past the base-end hook 90.

Another way which arguably is convenient involves pre-assembling the guide 18, the spring retainer 20 and the chisel 14 altogether as a unit, and then twisting this pre-assembly (or unit) onto the barrel 53. More particularly, that is, a user first pre-assembles the spring retainer 20 and chisel 14, and then inserts them into the guide 18. After that, the user twists the whole pre-assembly together as a unit, causing the spring coils 92/89 to wind onto the inverse thread 75. On the guide 18, one of the edges of the slot 62 contacts the trailing offset-hook 96, and this is where the driving force from the guide 18 is transferred to the spring retainer 20 to screw it onto the inverse thread 75. As is true when done by hand, the contact between the guide 18 and trailing offset-hook 96 causes the spring coils 92 ahead of the trailing offset-hook 96 to enlarge slightly in diameter, which reduces the frictional grabbing between the base-end coils 92/89 and the inverse thread 75.

The shank 71 of the chisel 14 forward of the axial stop 73 nests in the reduced-diameter half-coil 95 (see FIG. 8). Thumb pressure against the forward offset-hook 96 moves the reduced-diameter half-coil 95 aside to allow insertion and removal of the chisel 14 as desired.

Figure 6:
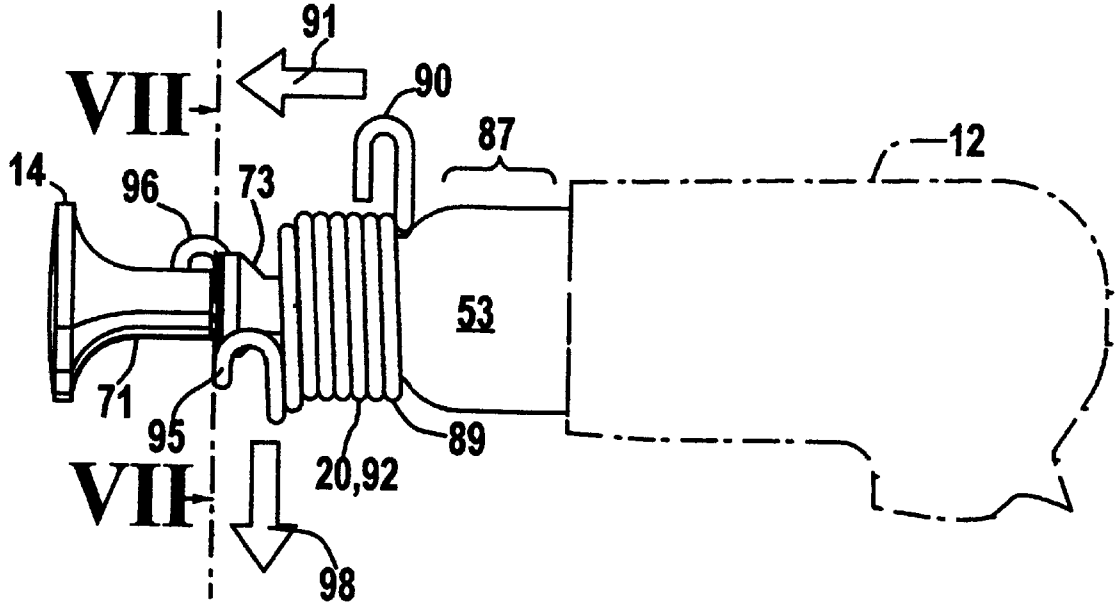
FIG. 6 is a side view thereof with the guide removed.

In a general sense, the provision of a beehive spring for retaining a impact-tool or chisel is fairly well known. FIGS. 6 and 7 give a general illustration of a spring retainer 20 and chisel 14. Beehive springs absorb the chisel thrust if the chisel does not otherwise bounce off the work (ie., the target). Simplicity and economy aside, a beehive spring generally is less popular with workers in the field than the mechanical locking retainer 70 of FIG. 4. The mechanical locking retainer 70 is believed to provide superior retention of the chisel (or other impact-tool).

FIGS. 6 and 7 illustrate a shortcoming of the prior art beehive spring arrangement (ie., sans guide 18). As mentioned, chisel-retention is purportedly achieved by virtue of the clip-on or latching reduced-diameter half-coil 95 gaining purchase around the shank 71 forward of the axial stop 73. Supposedly, the reduced-diameter half-coil 95 ought to always have a positive hold on the chisel 14. That way, if the air hammer 12 is misfired before the chisel 14 can be placed against the target, the spring retainer 20 will supply the recoil by virtue of the reduced-diameter half-coil 95 clipped or latched across the shank 71 at the axial stop 73. In actuality, this arrangement as shown by FIGS. 6 and 7 has provided a false sense of security.

What ends up happening (far too often) is shown by FIGS. 6 and 7. In FIGS. 6 and 7, the chisel 14 is shown at the peak of its thrust stroke. At the peak, the spring retainer 20 ought to be recoiling against the thrust stroke and returning the chisel 14 back into the barrel 53. What can and does happen is, that the reduced-diameter half-coil 95 deflects off the axis. The off-axis deflection or excursion of the spring 84's main coils 92 and transition section 94 is indicated by the down arrow 98 in the views. The off-axis excursion 98 eventually grows to where the clip or latching portion 95 loses its grip on the chisel shank 71 and hence releases the axial stop 73. The chisel 14 is then free to shoot away as a projectile. Given the foregoing, the mechanical locking retainer 70 of FIG. 4 enjoys much more popularity with workers in the field. At least it doesn't lose its chisel as spring retainers are known to.

FIGS. 8 and 9 show an inventive discovery in accordance with the invention. The guide 18 acts as a track providing support or buttressing to the spring retainer 20 and preventing it from deflecting off axis. As FIGS. 6 and 7 show, the unsupported spring retainer 20 wants to deflect down when it wants to move out of the way of the thrust of the chisel 14. However, in FIGS. 8 and 9, the spring retainer 20 is buttressed against downward deflection (eg., 98 in FIGS. 6 or 7) by the backing of the guide 18. Hence the reduced-diameter half-coil 95 maintains its purchase on the axial stop 73, even at the peak of the thrust. The reduced-diameter half-coil 95 won't yield its latch on the axial stop 73 given the support or backing of the guide 18 as shown by FIGS. 8 and 9.

Figure 1:
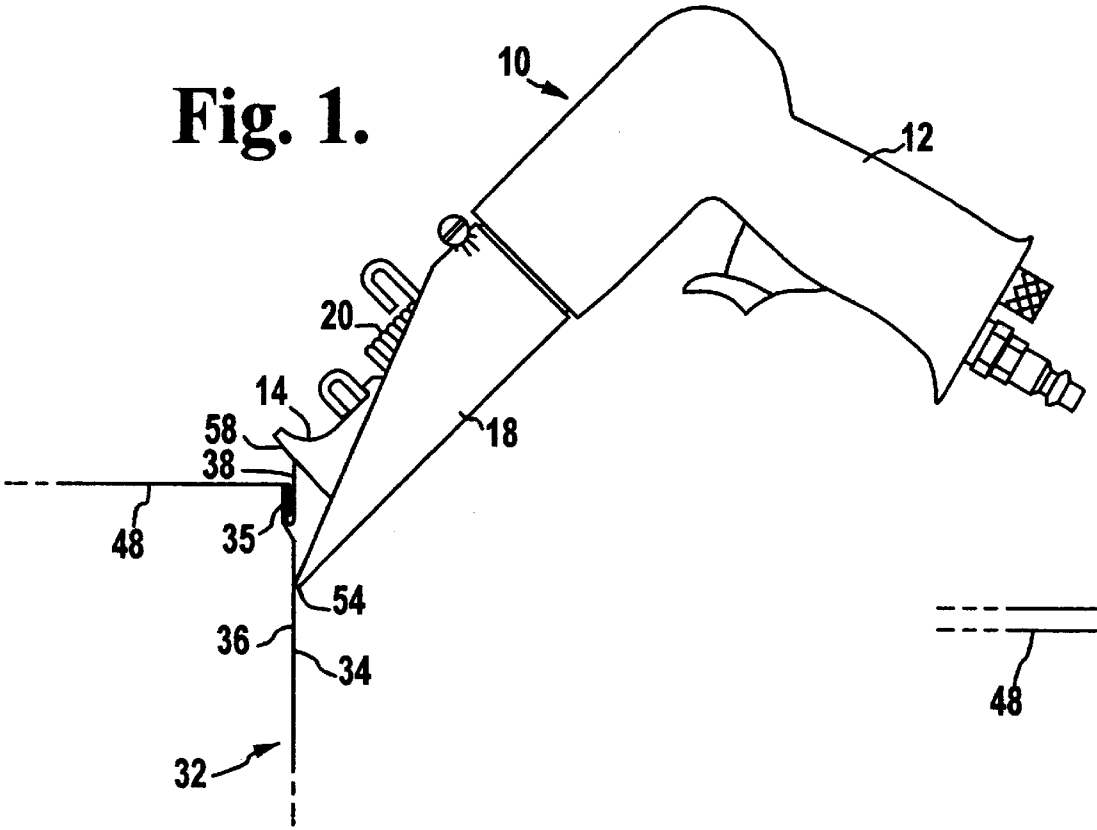
FIG. 1 is a perspective view of a handheld power-tool combination in accordance with the invention for sealing the seam of a sheet-metal duct-work comer using a Pittsburgh lock.
Figure 2:
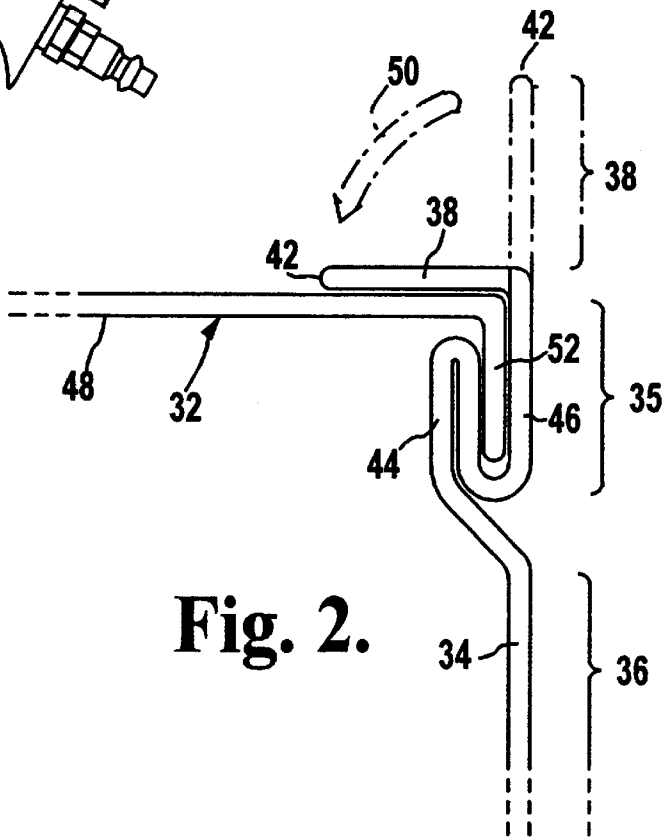
FIG. 2 is an enlarged scale detail thereof showing the Pittsburgh lock.
Figure 3B:
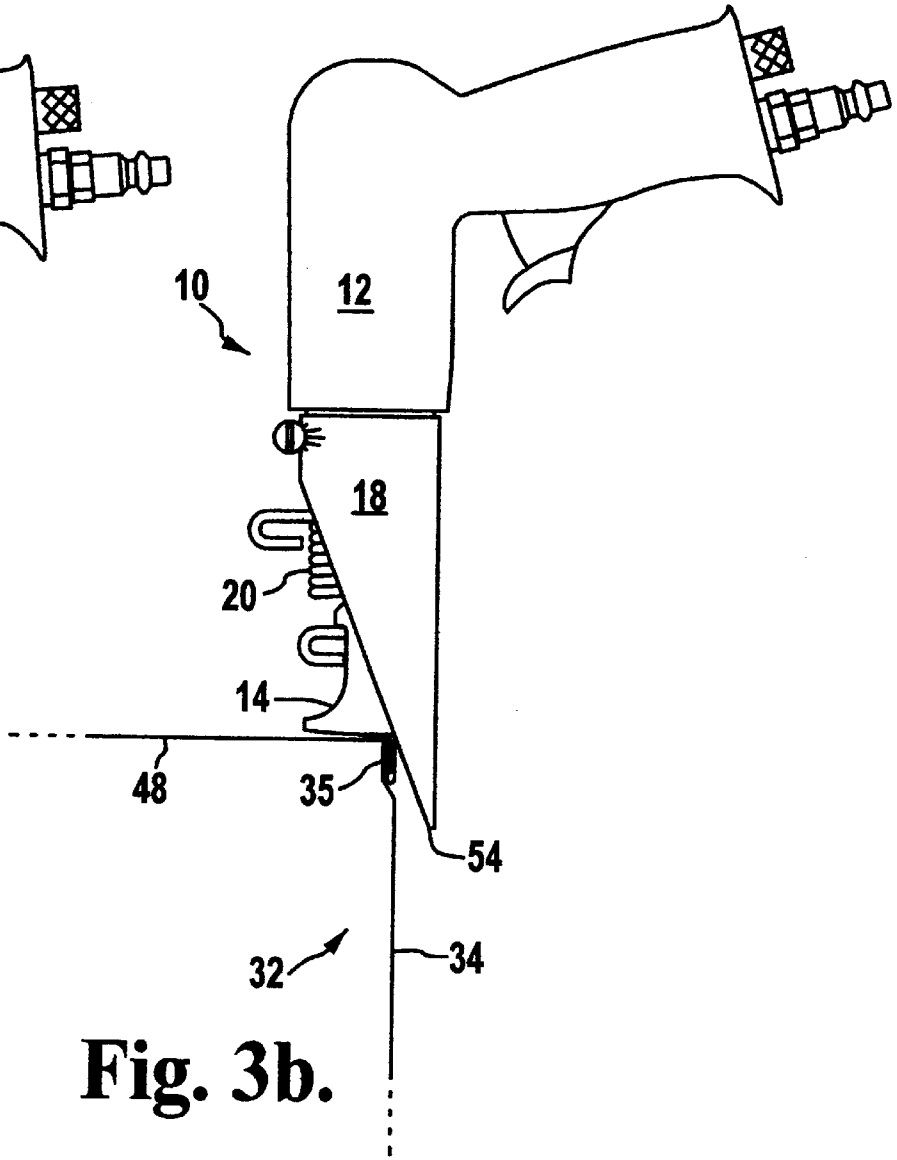
FIG. 3*b* perspective view comparable to FIG. 3*a* showing still another change in the angle of attack of the tool.
Figure 3A:
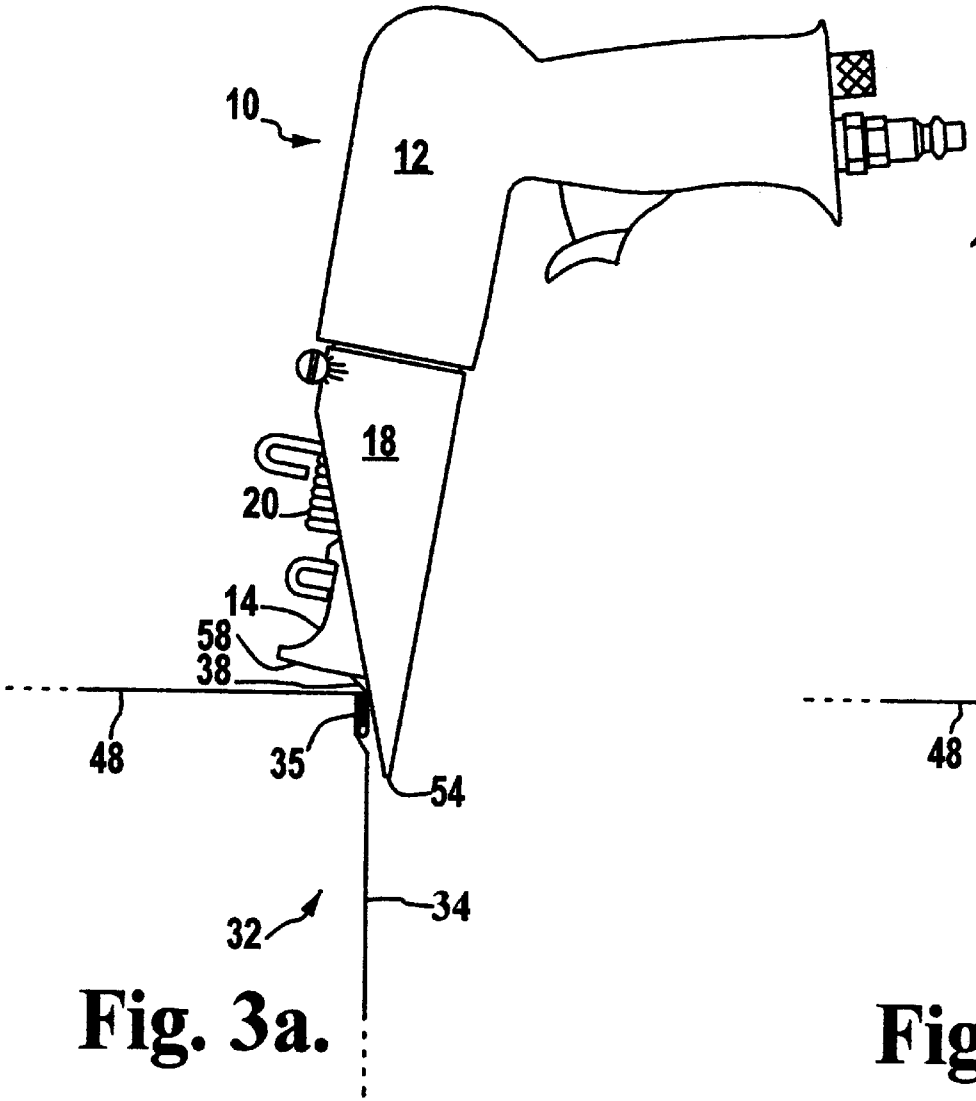
FIG. 3*a* perspective view comparable to FIG. 1 except showing a changed angle of attack of the tool.
Figure 4:
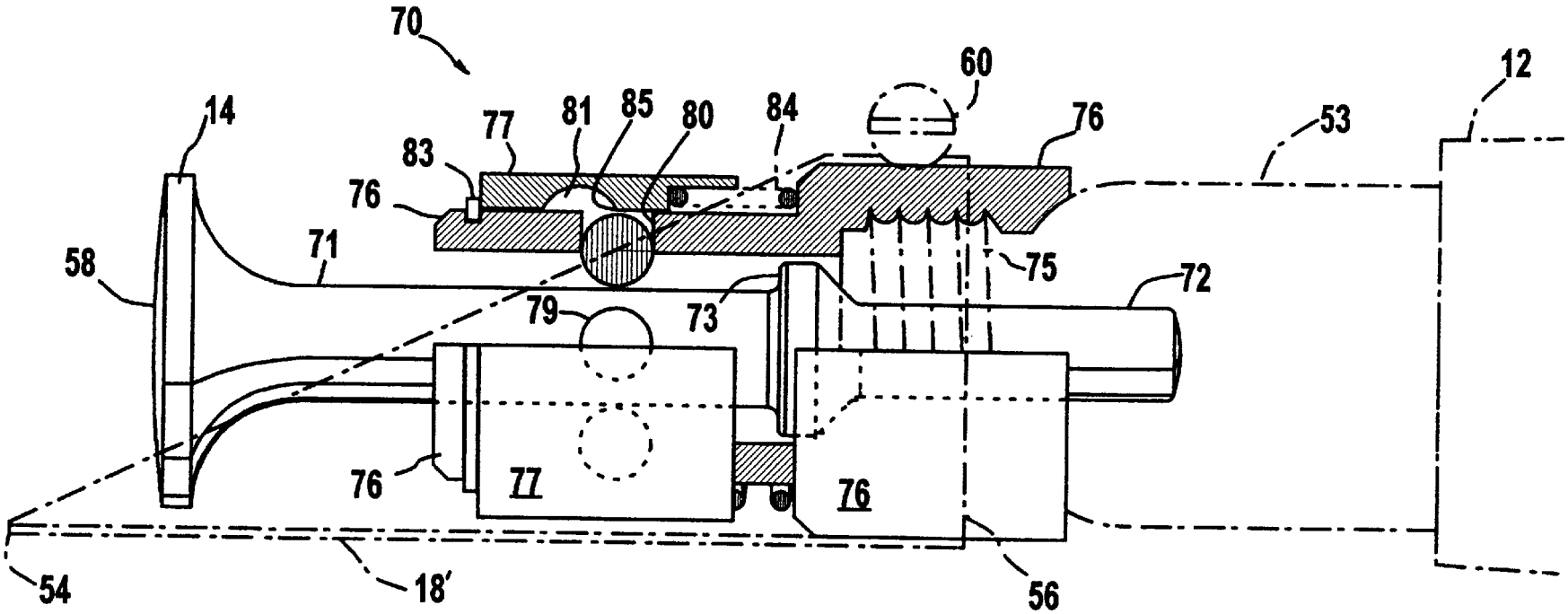
Fig. 4. (Prior Art)
FIG. 4 is an enlarged scale perspective view of a tool combination in accordance with the prior art for sealing the seam of sheet metal duct work comer using a Pittsburgh lock.

Therefore the combination guide 18 and spring retainer 20 in accordance with the invention, as installed on a cooperating air hammer 12, is simpler, more compact, and more economical than the mechanical locking retainer 70 of FIG. 4, and is comparably reliable, perhaps more foolproof, and has better chances of surviving hammer blows.

In order to obtain the advantages of the invention, the following design matters must be taken in consideration. The guide 18 should closely surround the outside diameter of the spring retainer 20. However, the spring retainer 20 is given sufficient clearance to reciprocate in the guide 18 as in a track. Both hook ends 90 and 96 of the spring retainer 20 should project out along about the same direction, or "up" as shown by FIGS. 8 and 9. They can be arranged a little differently but the issue here is, that the hook ends 90 and 96 have sufficient clearance in the slot 62 that bifurcates the guide 48 to allow relative axial displacement between the guide 18 and hook ends 90/96. As mentioned previously, it is preferred if the spring retainer 20 is mounted on the barrel 53 first, followed by telescoping on the guide 18. This requires temporarily removing the machine screw 68 while sliding the eye-loops 64/66 past the base-end hook 90.

Another aspect that matters is the following. FIG. 9 shows an arc portion of the last regular coil indicated as 97. This arcuate portion 97 definitely should be situated such that it is cupped or buttressed by the guide 18. It is the support or buttressing of this portion 97 of the regular coils 92 that best prevents the shank-latching half-loop 95 from deflecting off axis.

A further aspect includes the cooperation between the guide 18 and retainer spring 20 while the guide 18 is clamped on the barrel 53. The guide 18 prevents the retainer spring 20 from unscrewing OFF the inverse thread portion 75 of the barrel 53. Hence the guide 18 cooperatively locks the retainer spring 20 onto the barrel 53. The base-end hook 90 is simply obstructed from screwing or unscrewing beyond the confined limits set for it by the slot 62 traversing the guide 18.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A tool for folding sheet metal edges comprising:

a pneumatic hammer with a stepped barrel having a round proximal portion and a reduced-down distal portion externally formed with inverse spring thread;

a plunger having a shank having a work-striking head, a butt end that loads or retracts into the hammer barrel, and intermediate axial-stop means disposed therebetween;

a plunger-retaining spring having a main body formed on a major diameter, a shank-latching portion formed on a minor diameter, and a transition section therebetween;

wherein the main body comprises a series of closed regular coils which partly thread onto the inverse spring thread of hammer barrel and in other part, with inclusion of the transition section, generally project so that the shank-latching portion latches across the shank of the retracted plunger just forward of the axial stop, whereby axial extensions of the spring normally retract the plunger back into the hammer barrel; and, a rigid guide having a base end formed with an internally cylindrical clamping means for clamping onto the hammer barrel proximal portion, and at the other end, a guide lip which, while the guide is attached to the hammer, projects past and below the striking head of the plunger, as well as having an intermediary channel portion which internally closely surrounds portions of the spring for buttressing the transition section of the spring, and those coils of the main body proximate thereto, from off-axis excursions.

2. The tool of claim 1 wherein the rigid guide is substantially formed from a tube being generally cross-section cut at the base end, and at said other end, being formed in a wedge shape in which the guide lip is formed from a tip end of the wedge.

3. The tool of claim 2 wherein the wedge shape is formed along a straight plane.

4. The tool of claim 2 wherein the intermediary channel portion of the guide is defined by an internally cylindrical transect portion of the tube, the tube diameter being sized to measure about equal to the major diameter of the plunger-retaining spring except including a measure for closely spaced clearance.

5. The tool of claim 2 wherein clamping means comprises forming the base end with a slot that bifurcates the base end generally at the narrowest span between the base end and the wedge, providing a pair of spaced eye-loops flanking the slot and a threaded fastener spanning between the two eye-loops such that tightening the fastener causes the tubewall to contract and more tightly clamp on the round proximal portion of the hammer barrel.

6. The tool of claim 1 wherein guide lip of the guide is situated to prop and/or slide against a wall of sheet metal and also act as a fulcrum and hence allow a user to vary the angle-of-attack of the work-striking head relative to the work-piece/sheet metal edge.

7. The tool of claim 1 wherein the transition section of the spring comprises an involuted cone as formed by a half a coil that reverses the direction of coiling relative to the spring's main body of coils, wherein this reversing half-coil is generally contained in the imaginary surface of a cone.

8. The tool of claim 1 wherein the shank-latching portion of the spring comprises a partial coil, and the minor diameter therefor is sized to measure about equal to the diameter of the plunger shank.

9. The tool of claim 8 wherein the plunger-retaining spring further comprises opposite hook ends, one which forms the terminus for the main body and extends externally such that it projects radially outward along an imaginary spoke from the center axis of the spring, and the other which forms the terminus for the shank-latching portion and is formed offset such that it projects radially outward along an imaginary tangent of the shank-latching partial-coil.

10. The tool of claim 9 wherein the guide has a tubular form which is provided with a clearance gap that extends in transection and which bifurcates the guide including the base end, wherein the clearance gap is arranged to provide sufficient clearance for the spring's hook ends as at least to allow free axial displacement between the guide and the shank-latching portion's hook end.

11. The tool of claim 10 wherein the clearance gap, as formed in the guide's base end and while the guide is clamped on the hammer barrel, permits the through extension of the main body's hook end concurrently as the guide's base end prevents by obstruction the retainer spring from unscrewing OFF the inverse thread portion of the hammer barrel.

12. A spring and guide combination for a conventional pneumatic hammer and chisel of the type in which the pneumatic hammer has a stepped barrel including a round base portion and a reduced-down distal portion externally formed with inverse spring thread, and in which the chisel has a shank terminating in a butt end which reciprocates between extension and retraction in the hammer barrel as well as having an intermediate axial-stop means; wherein, said combination for folding sheet metal edges comprises:

a chisel-retaining spring having a main body formed on a given diameter, a shank-latching portion, and a transition section intermediate therebetween;

the main body comprising a series of closed regular coils which partly thread onto the inverse spring thread of hammer barrel and in other part, with inclusion of the transition section, generally project so that the chisel-latching portion latches across the shank of the retracted chisel forward of the axial stop, whereby axial extensions of the spring normally retract the chisel back into the hammer barrel; and, a guide having a base end formed with clamping means for clamping onto the hammer barrel base portion, and at the other end, a guide lip to prop and/or slide against a wall of sheet metal and also act as a fulcrum and hence allow a user to vary the angle-of-attack of the chisel relative to the work-piece/sheet metal edge;

the guide including an intermediary channel portion which internally closely surrounds portions of the spring for buttressing the transition section of the spring, and those coils of the main body proximate thereto, from off-axis excursions and thereby prevent against the latching portion of the spring from unlatching off the chisel shank.

13. The combination of claim 12 wherein the guide is substantially formed from a tubular form being generally cross-section cut at the base end, and at said other end, being formed in a wedge shape in which the guide lip is provided by a tip end of the wedge.

14. The combination of claim 13 wherein the intermediary channel portion of the guide is defined by an internally concave transect portion of the tubular form.

15. The combination of claim 12 wherein clamping means comprises forming the guide base end with a slot that extends in transection and which bifurcates the base end, as well as providing a pair of spaced eye-loops which flank the slot and a threaded fastener which spans between the two eye-loops.

16. The combination of claim 12 wherein the transition section of the spring comprises about a half a coil that reverses the direction of coiling relative to the spring's main body of coils, wherein this reversing half-coil is generally contained in the imaginary surface of a cone.

17. The combination of claim 12 wherein the shank-latching portion of the spring comprises a partial coil having a diameter about equal to the diameter of the chisel shank.

18. The combination of claim 17 wherein the chisel-retaining spring further comprises opposite hook ends, one which forms the terminus for the main body and extends externally such that it projects radially outward along an imaginary spoke from the center axis of the spring, and the other which forms the terminus for the shank-latching portion and which is offset such that is projects radially outward along an imaginary tangent of the shank-latching partial-coil.

19. The combination of claim 18 wherein the guide has a tubular form which is provided with a clearance gap that extends in transection and which bifurcates the guide including the base end, wherein the clearance gap is arranged to provide sufficient clearance for the spring's hook ends as to at least allow free axial displacement between the guide and the shank-latching portion's hook end.

20. The combination of claim 19 wherein the clearance gap, as formed in the base end of the guide and while the guide is clamped on the hammer barrel, permits the through passage of the main body's hook end concurrently as the guide's base end prevents by obstruction the retainer spring from unscrewing OFF the inverse thread portion of the hammer barrel.

* * * * *